US005541610A

United States Patent [19]

Imanishi et al.

[11] Patent Number: 5,541,610

[45] Date of Patent: Jul. 30, 1996

[54] ANTENNA FOR A RADIO COMMUNICATION APPARATUS

[75] Inventors: Yasuhito Imanishi; Eriko Komori, both of Hyogo, Japan

[73] Assignee: Mitsubishi Denki Kabushiki Kaisha, Tokyo, Japan

[21] Appl. No.: 534,397

[22] Filed: Sep. 27, 1995

[30] Foreign Application Priority Data

Oct. 4, 1994 [JP] Japan ..... 6-240122

[51] Int. Cl.[6] ..... H01Q 1/24; H01Q 1/12; H01Q 11/08

[52] U.S. Cl. ..... 343/702; 343/895; 343/718

[58] Field of Search ..... 343/702, 895, 343/718, 860, 866, 741; H01Q 1/24, 1/12, 11/08, 1/36

[56] References Cited

U.S. PATENT DOCUMENTS

| | | | |
|---|---|---|---|
| 4,873,527 | 10/1989 | Tan | 343/718 |
| 5,250,923 | 10/1993 | Ushiro et al. | 336/83 |
| 5,374,937 | 12/1994 | Tsunekawa et al. | 343/702 |
| 5,412,392 | 5/1995 | Tsunekawa | 343/702 |

FOREIGN PATENT DOCUMENTS

| | | |
|---|---|---|
| 0564236 | 10/1993 | European Pat. Off. . |
| 0593185 | 4/1994 | European Pat. Off. . |
| 0590534 | 4/1994 | European Pat. Off. . |
| 59-017705 | 1/1984 | Japan . |
| 06069057 | 3/1994 | Japan . |

OTHER PUBLICATIONS

Sakakura et al., "Ultra–Miniature Chip Inductors Serve at High Frequency" JEE Jour. of Elec. Engin., vol. 30, No. 324, Dec. 1993, pp. 48–51.

*Primary Examiner*—Hoanganh Le
*Attorney, Agent, or Firm*—Rothwell, Figg, Ernst & Kurz

[57] ABSTRACT

An antenna equipment employing a chip inductor based antenna includes a multilayered miniaturized chip inductance element having an approximately λ/4 wavelength which achieves a half-wave dipole antenna performance together with a ground having an approximately λ/4 wavelength. In a preferred embodiment, the inductance element is formed of a plurality of thin sheets of insulating material carrying conductor segments which are connected through via-holes in the sheets to form a spiral inductance element within the stack of sheets. Direct connection avoids impedance matching circuit insertion loss and low-cost miniaturization with reduced antenna gain deterioration from surrounding conductors is provided for an effective miniature portable radio communication apparatus.

18 Claims, 12 Drawing Sheets

ANTENNA FOR A RADIO COMMUNICATION APPARATUS

BACKGROUND OF THE INVENTION

1. Field of the Invention

The present invention relates to the field of antenna structures for portable apparatus applications and more specifically to compact or miniature antenna equipment suited for use with miniaturized portable radio communication apparatus.

2. Description of the Conventional Art

FIG. 14 shows a sectional portable radio communication apparatus equipped with a conventional helical antenna. Referring to the figure, an insulating resin housing 101 houses a radio circuit 103 enclosed in a metal frame 102. A helical antenna 104 is covered by an insulating cover 106 and fixed perpendicularly on a top surface of the resin housing 101. The helical antenna 104 of helically wound line conductor has an approximately λ/4 wavelength and is connected directly to the radio circuit 103 via a connection lead 105. An impedance matching circuit is not required in this case for the low load impedance of the antenna 104 because the voltage of a received wave is low enough at the feeder end connected to the connection lead 105 to match the radio circuit 103.

The approximately λ/4 wavelength helical antenna 104 acts as an approximately λ/4 wavelength monopole antenna when fed by the radio circuit 103. The metal frame 102 having an approximately λ/4 wavelength serves as a ground plane for the helical antenna 104 when insulated from the operator's hand or body by the resin housing 101. The combination of the approximately λ/4 wavelength helical antenna 104 and the approximately λ/4 wavelength metal frame 102 achieves an antenna performance or radiation pattern corresponding to that of a half-wave dipole antenna.

FIG. 15A shows a horizontal plane radiation pattern of a dipole antenna according to the conventional helical antenna of FIG. 14 and FIG. 15B shows the vertical plane radiation pattern as actually measured.

FIG. 16 shows a VSWR, Voltage Standing Wave Ratio, characteristic of the conventional helical antenna 104.

Thus, the conventional approximately λ/4 wavelength helical antenna acting as a monopole antenna effects the miniaturization of the antenna. The conventional approximately λ/4 wavelength helical antenna is physically smaller, for example, than a λ/4 whip antenna in physical length and is suited to a miniature portable radio communication apparatus.

The conventional helical antenna of the helically wound line conductor, however, is easily affected by surrounding conductors. Coiling or winding of line element can result in deviations in size and in dimensions lacking precision, thereby resulting in failure to provide consistent antenna performance. The conventional helical antenna is also limited as to the degree of miniaturization. Helically wound line elements have physical limits of miniaturization which make them inapplicable to highly miniaturized portable radio communication apparatus such as pagers and wristwatch-type radio communication apparatus.

The present invention is directed to solving the foregoing and other problems by providing antenna equipment suited to miniaturized portable applications where the antenna must be compact enough for the highly miniaturized housing of portable radio communication apparatus and wherein the effects of surrounding conductors such as the user's body are eliminated by detuning.

SUMMARY OF THE INVENTION

This and other objects are accomplished by the following aspects of the present invention.

According to one aspect of the present invention, an antenna equipment for use with radio waves of a predetermined wavelength comprises a metal case for containing a radio circuit; a plastic case surrounding and electrically insulating the metal case; and an antenna element of a predetermined wavelength for transmitting/receiving radio waves from/to the radio circuit, the antenna element comprising a multilayered inductance element formed of a plurality of sheets of insulating material stacked upon one another to form a stack, with conductor segments of a spirally shaped inductance element being carried separately on the sheets and being electrically connected to each other through via-holes extending through the sheets to form the multilayered inductance element in the form of a continuous conductor formed of the conductor segments and extending spirally within the stack of the sheets, the antenna element being mounted externally of the metal case.

According to another aspect of the invention, an antenna equipment for use with radio waves of a predetermined wavelength comprises a metal case for containing a radio circuit; a multilayered inductance element forming a first element of an antenna with an equivalent wavelength approximately corresponding to the predetermined wavelength for transmitting/receiving the radio waves from/to the radio circuit, in which the multilayered inductance element is formed of a plurality of sheets of insulating material stacked upon one another to form a stack, with conductor segments of a spirally shaped inductance element being carried separately on the sheets and being electrically connected to each other through via-holes extending through the sheets to form the multilayered inductance element in the form of a continuous conductor formed of the conductor segments and extending spirally within the stack of the sheets to form a spiral antenna element; a metal band for supporting the metal case and the multilayered inductance element, in which the combination of the metal band and the metal case, acting as a ground, forms a second element of the antenna which has as a first element thereof the multilayered inductance element; and a plastic plate for insulating the multilayered inductance element and the metal case.

BRIEF DESCRIPTION OF THE DRAWINGS

The present invention will be better understood with reference to the accompanying drawings, in which.

DESCRIPTION OF THE PREFERRED EMBODIMENTS

Embodiment 1

Figure 1:
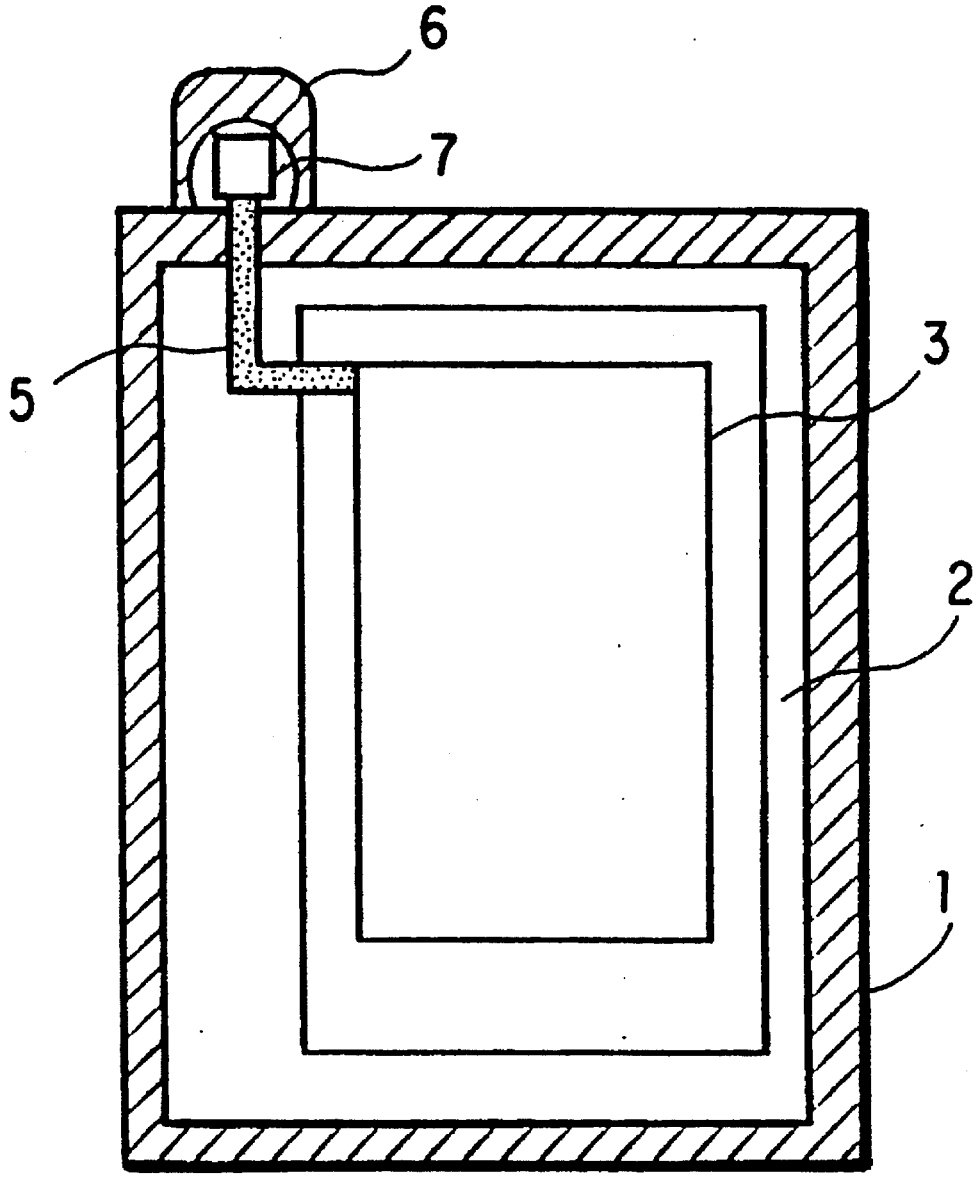
FIG. 1 shows a sectional diagram of a portable radio communication apparatus equipped with a chip inductor antenna according to a first embodiment of the present invention.

FIG. 1 shows a sectional diagram of a portable radio communication apparatus equipped with a chip inductor based antenna according to a first embodiment of the present invention. The portable radio communication apparatus contains a radio circuit 3 enclosed in a metal case or metal frame 2 which acts as an electro-magnetic shield. The metal frame 2 is surrounded by an insulating plastic case or resin housing 1 which insulates the metal frame 2 from the operator's hand. The chip inductor based antenna includes an inductance element 7 covered by an insulating cover 6 having a low permitivity. The inductance element 7 is fixed on a top surface of the insulating resin housing 1 with the lower portion extending within the housing 1 and electrically connected to the radio circuit 3 via a connection lead 5.

Figure 2A:
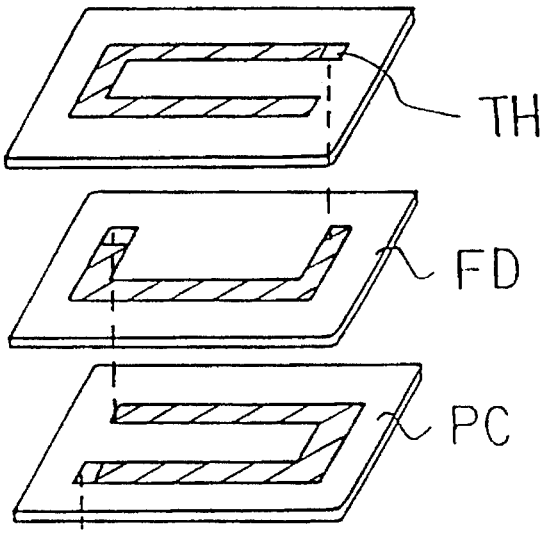
FIG. 2A shows a multi-layer construction of the chip inductor for the chip inductor antenna of FIG. 1 using U-shaped conductor segments to be printed on adjacent sheets together forming a conductor spiral.
Figure 2B:
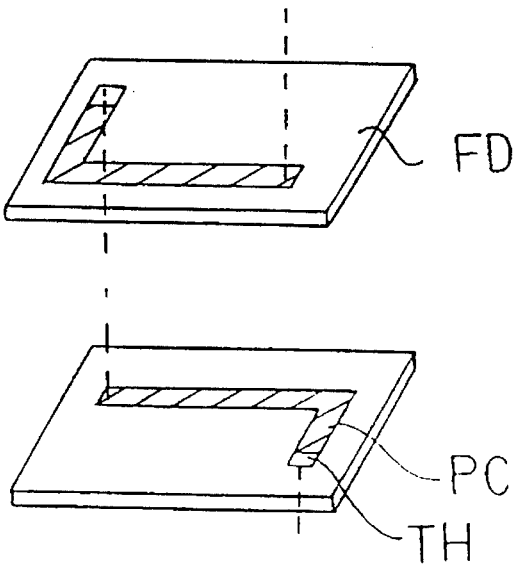
FIG. 2B shows a multi-layer construction of the chip inductor for the chip inductor antenna of FIG. 1 using L-shaped conductor segments to be printed on adjacent sheets together forming a conductor spiral.

The inductance element 7 is a chip inductor which is formed using a ferrite material technology and multi-layer green-sheet interconnection technology. FIGS. 2A and 2B show the multi-layer construction of the chip inductor of the inductance element 7 illustrating a series of ferrite thin sheets or green-sheets with conductor segments printed on adjacent sheets and together forming a conductor spiral. Ferrite green-sheets labeled FD have different patterns of conductors labeled PC with low sheet resistance printed thereon and which are joined one on top of the other via through-holes labeled TH to form a conductor spiral in a multi-layer entity and then fired for a finishing. That is, the printed conductor portions PC of the inductor are joined to adjacent printed conductors through the through-holes or via-holes TH so that the conductor portions PC form a spiral inductor extending within the flat stack of sheets. FIG. 2A illustrates U-shaped conductor segments of a conductor spiral printed on the adjacent sheets of the chip inductor. FIG. 2B illustrates L-shaped conductor segments of a conductor spiral printed on the adjacent sheets of the chip inductor. An example of a commercial based chip inductor is a miniature chip inductor, Product Type Number 1005, with 1.0 mm in length, 0.5 mm in width and 0.5 mm in height, which has been found suited to the miniature portable radio communication apparatus of the present invention. Chip inductors are mass produced on a commercial basis, which contributes to products of consistent size and dimensions for even antenna performance at low cost. The term "spiral" as used herein is not limited to a continuously curving spiral but includes generally spiral shapes formed of linear segments as shown in FIGS. 2A and 2B.

The inductance element 7 having approximately $\lambda/4$ of wavelength acts as an approximately $\lambda/4$ wavelength monopole antenna when fed by the radio circuit 3. The metal frame 2 having approximately $\lambda/4$ of wavelength serves as a ground plane of the monopole antenna. Accordingly, the combination of the inductance element 7 and the metal frame 2 achieves an antenna performance or radiation pattern corresponding to that of a half-wave dipole antenna. An approximately $\lambda/4$ of wavelength monopole antenna has a low antenna or load impedance and requires no impedance matching circuit between the antenna and a radio circuit. This improves antenna performance with no impedance matching circuit insertion loss and also contributes to miniaturization of the resin housing 1.

Figure 3A:
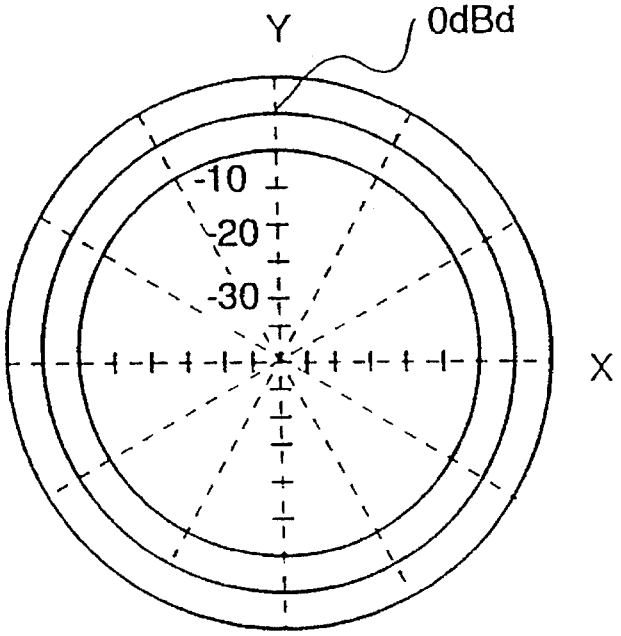
FIG. 3A shows the horizontal plane radiation pattern of the chip inductor antenna of FIG. 1 as actually measured.
Figure 3B:
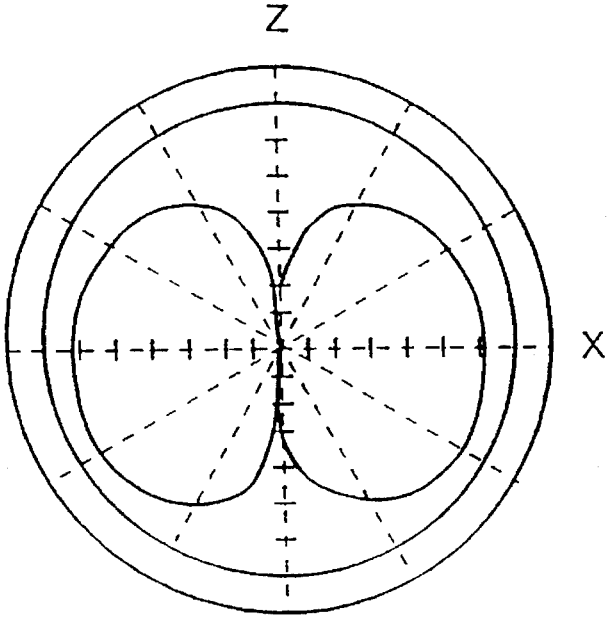
FIG. 3B shows the vertical plane radiation pattern of the chip inductor antenna of FIG. 1 as actually measured.
Figure 15A:
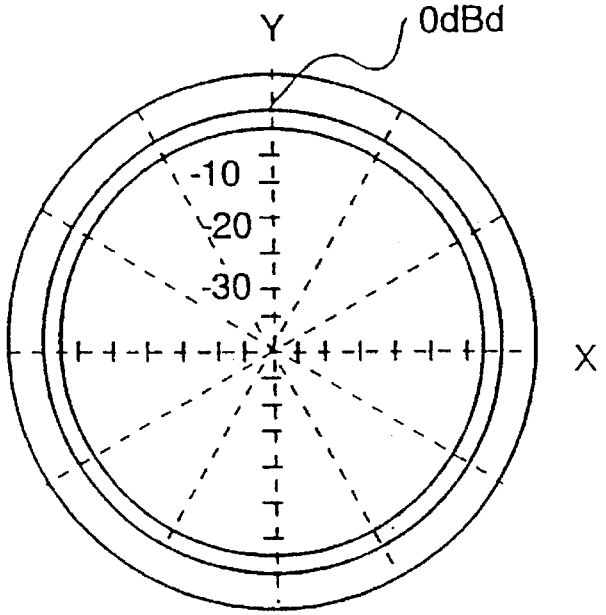
Fig.15 A CONVENTIONAL ART
FIG. 15A shows a horizontal plane radiation pattern of dipole antenna in actual measurement according to the conventional helical antenna of FIG. 14.
Figure 15B:
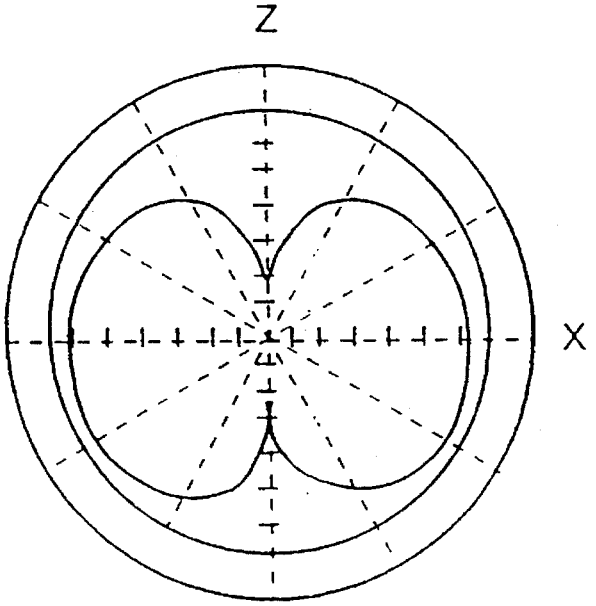
Fig.15 B CONVENTIONAL ART
FIG. 15B shows a measured vertical plane radiation pattern of the conventional helical antenna of FIG. 14.

FIGS. 3A and 3B show the radiation patterns of the chip inductor based antenna according to this embodiment in actual measurement. FIG. 3A is a horizontal plane radiation pattern of the antenna and FIG. 3B is the vertical plane radiation pattern. The radiation patterns of FIGS. 3A and 3B show the equivalence of the radiation patterns of the antenna of FIG. 1 to those of the conventional helical antenna as shown in FIGS. 15A and 15B. It is thus seen that the combination of the inductance element 7 and the metal frame 2 has almost the same antenna characteristic as that of a half-wave dipole antenna.

Thus, the art of the chip inductor based antenna according to this embodiment is free of impedance matching circuit insertion loss, and is a low-cost miniature antenna with half-wave dipole antenna performance which is suited to miniaturized portable radio communication apparatus.

Embodiment 2

Figure 4:
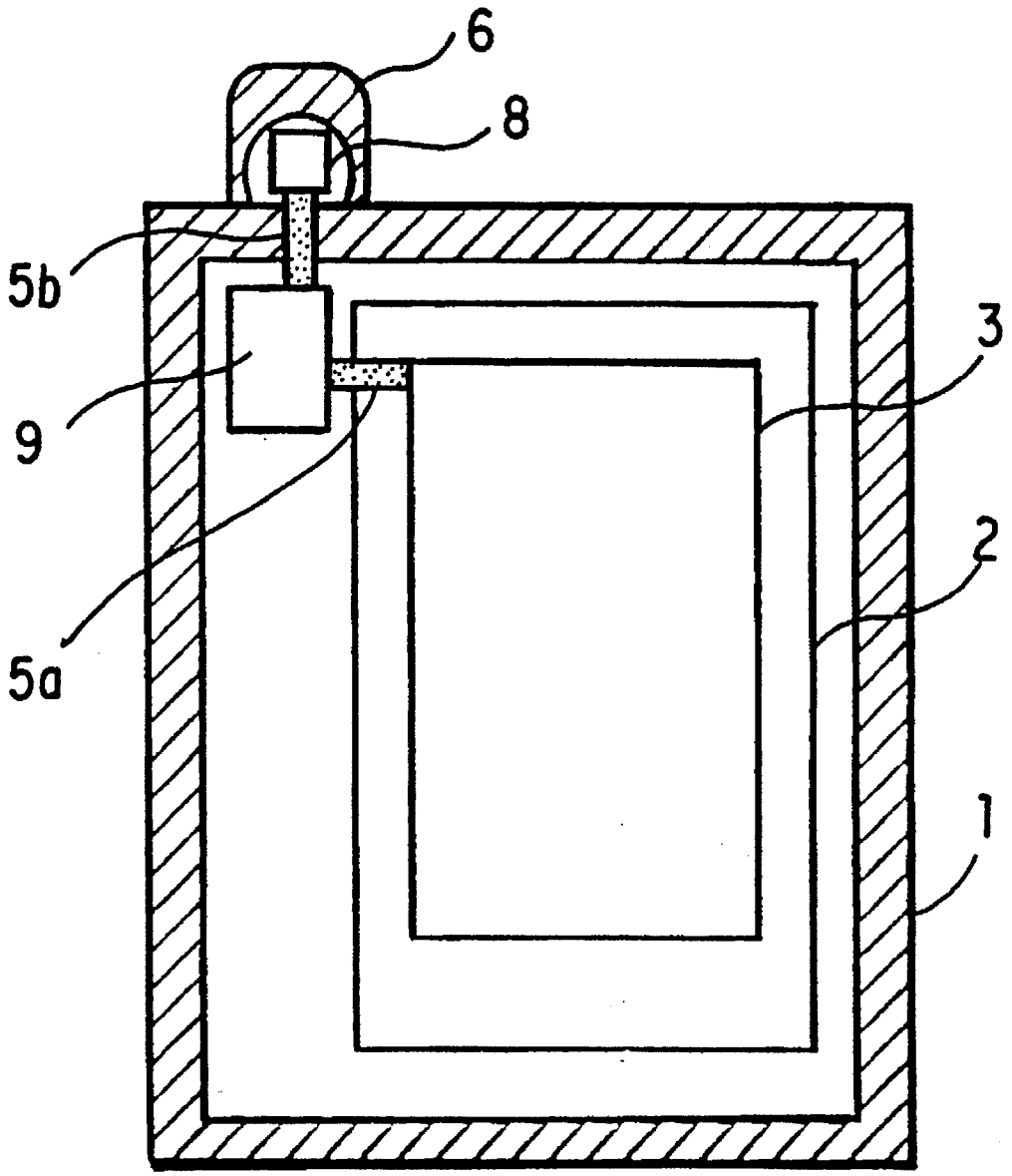
FIG. 4 shows a sectional diagram of a portable radio communication apparatus equipped with a chip inductor antenna according to a second embodiment of the present invention.

FIG. 4 is a sectional diagram of a portable radio communication apparatus equipped with a chip inductor based antenna according to a second embodiment of the present invention. The embodiment of FIG. 4 modifies the embodiment of FIG. 1 with the substitution of an approximately λ/2 wavelength inductance element 8 with an additional matching circuit 9 for the approximately λ/4 wavelength inductance element 7. The inductance element 8 is of the same multilayered chip structure as inductance element 7 of the previous embodiment but the value of the wavelength is λ/2 instead of λ/4. The inductance element 8 is covered with the insulating cover 6 and fixed on a top surface of the insulating resin housing 1 with the lower portion extending within the housing 1. The matching circuit 9 is placed within the insulating resin housing 1 between the inductance element 8 and the metal frame 2 and is connected to the radio circuit 3 via a connection lead 5*a* on the metal frame side and connected electrically to the inductance element 8 via a connection lead 5*b* on its other side.

The inductance element 8 is approximately λ/2 in wavelength and acts as an approximately λ/2 wavelength monopole antenna having an antenna performance corresponding to that of a half-wave dipole antenna. The approximately λ/2 wavelength monopole antenna has almost infinite impedance, which differs greatly from the impedance of the radio circuit 3 and requires the impedance matching circuit 9. High impedance in the antenna prevents the electric current from flowing in the metal frame 2, so that less antenna gain loss occurs from the deteriorating effect of the user's hand touching the insulating resin housing 1.

Figure 5:
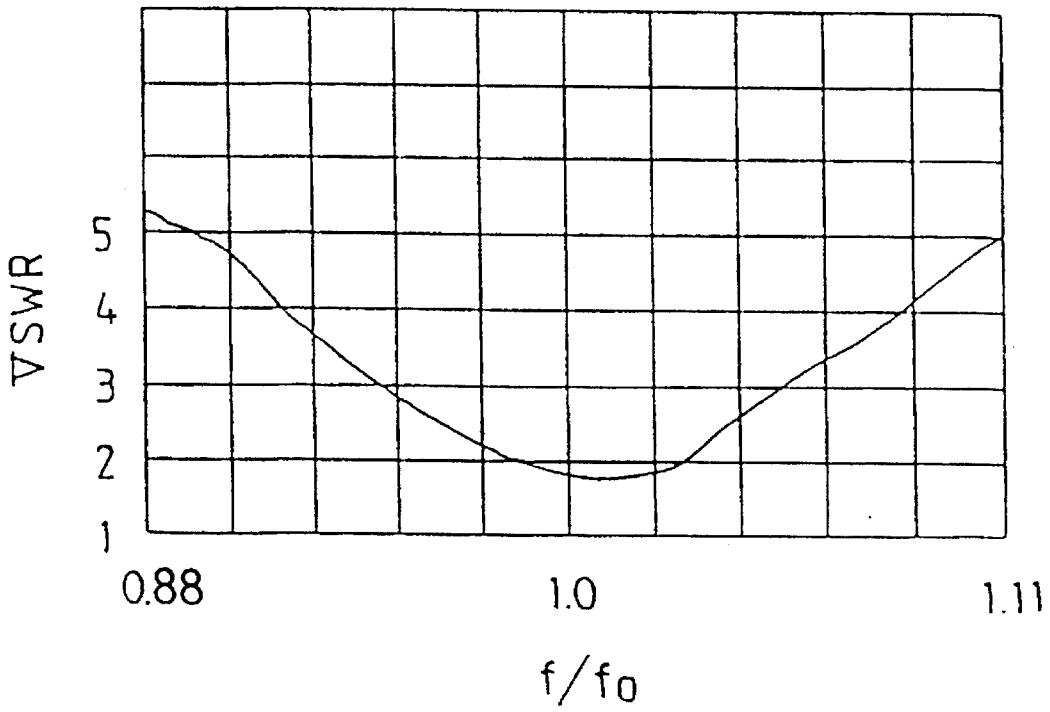
FIG. 5 shows the VSWR characteristic of the chip inductor antenna of FIG. 4.
Figure 16:
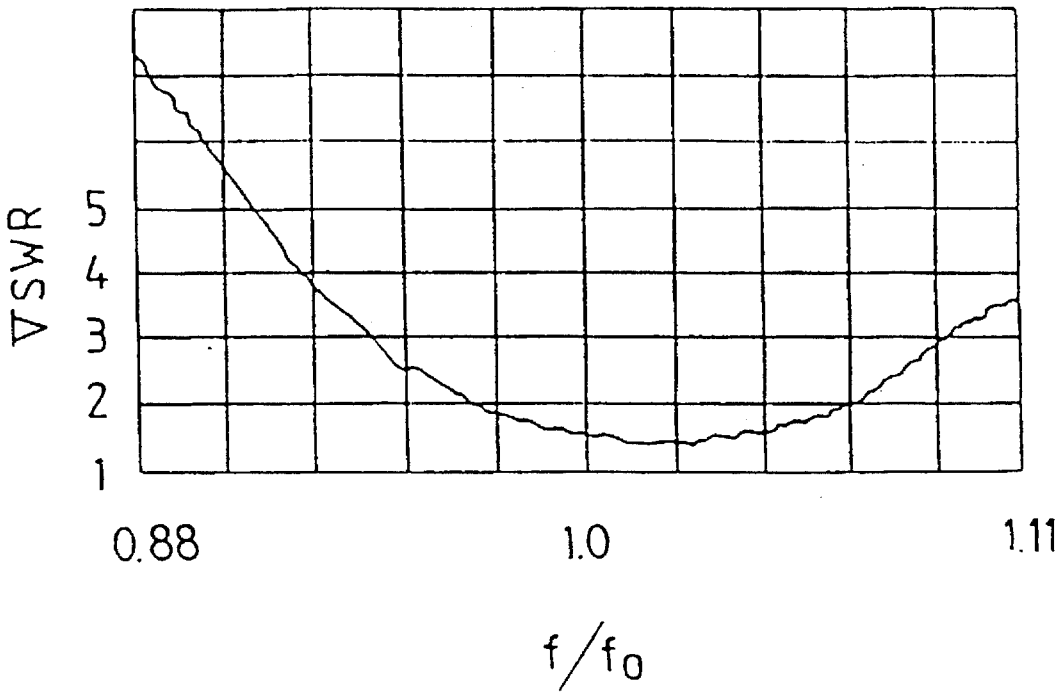
Fig.16 CONVENTIONAL ART
FIG. 16 shows a VSWR characteristic of the conventional helical antenna of FIG. 14.

The characteristic of the voltage standing wave ratio, VSWR, of the approximately λ/2 wavelength inductance element 8 is improved by inserting the impedance matching circuit 9. FIG. 5 shows the VSWR characteristic of the chip inductor based antenna according to this embodiment. Referring to FIG. 5, f stands for frequency and fo stands for center frequency. The VSWR characteristic of the chip inductor based antenna including the inductance element 8 and the matching circuit 9 shows equivalence to that of the conventional helical antenna of FIG. 16.

Thus, the art of the chip inductor based antenna according to this embodiment achieves low-cost miniaturization with an improved VSWR characteristic and with half-wave dipole antenna performance and less gain deteriorating effect from the proximity of the operator's body.

Embodiment 3

Figure 6:
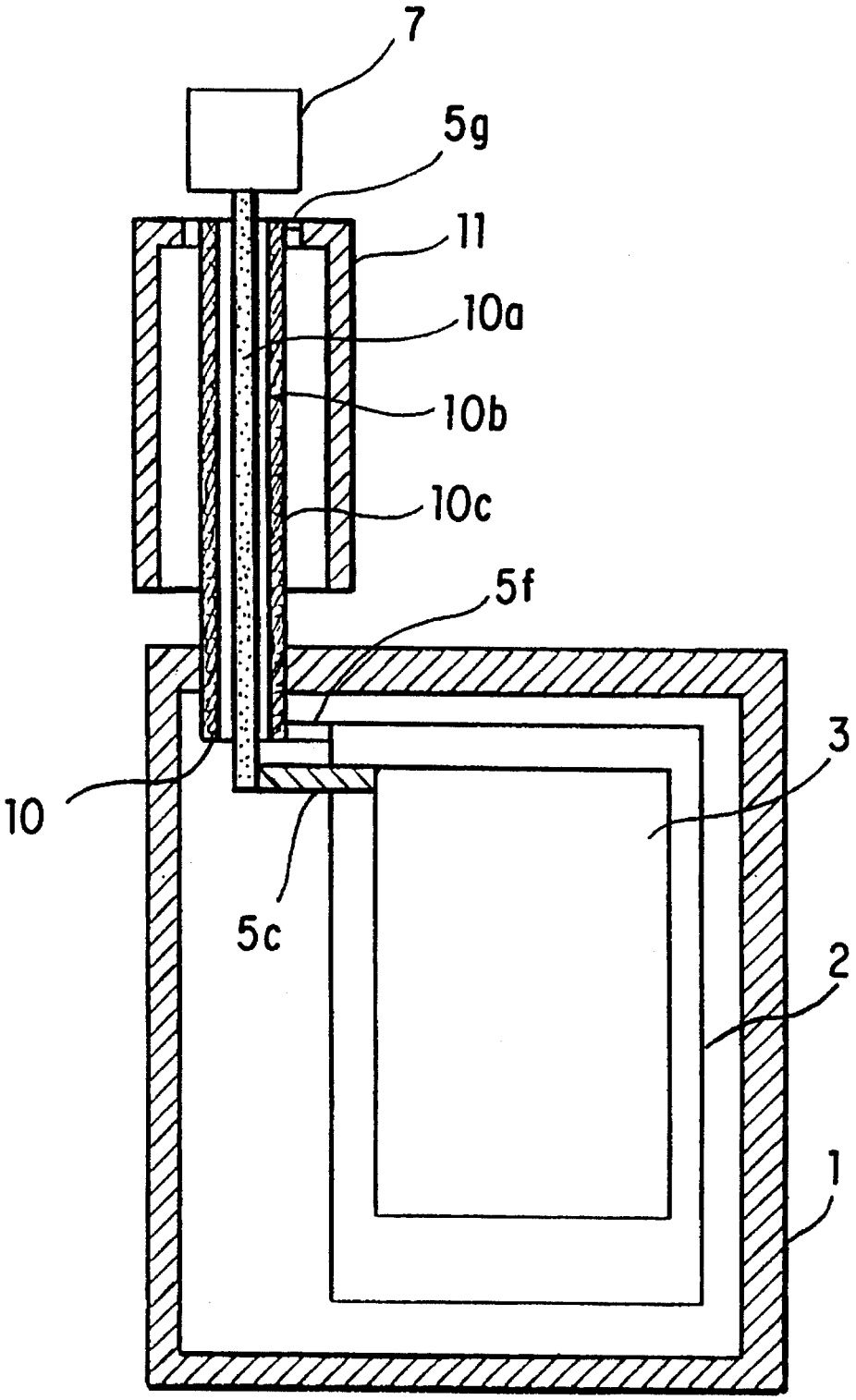
FIG. 6 shows a sectional diagram of a portable radio communication apparatus equipped with a chip inductor coaxial line antenna according to a third embodiment of the present invention.

FIG. 6 is a sectional diagram of a portable radio communication apparatus equipped with a chip inductor based coaxial line antenna according to a third embodiment of the present invention. The embodiment of FIG. 6 modifies the embodiment of FIG. 1 with the substitution of a coaxial line together with the inductance element 7 and a cylindrical sleeve for the inductance element 7 alone of the embodiment of FIG. 1.

Referring to FIG. 6, the chip inductor based coaxial line antenna includes a coaxial line 10, the approximately λ/4 wavelength inductance element 7 and an approximately λ/4 wavelength coaxial cylindrical sleeve 11. The coaxial line 10 is composed of a core line 10*a* of conducting material covered by an insulating material 10*b* with a metal casing or outer cover 10*c* of braided wire. The conducting core line 10*a* is connected to the radio circuit 3 at its lower end via a connection lead 5*c* and is directly connected to the inductance element 7 at the top end of the core line 10*a*. The outer cover 10*c* is connected at its lower end to the metal frame 2 via a connection lead 5*f* and at its upper end to the cylindrical sleeve 11 via a connection lead 5*g*. The cylindrical sleeve 11 partially encloses the coaxial line 10 on the common axis and is insulated from the coaxial line 10 with the exception of the upper portion connected by lead 5*g* to the upper end of the outer cover 10*c*.

The combination of the approximately λ/4 wavelength inductance element 7 and the approximately λ/4 wavelength cylindrical sleeve 11 achieves an antenna performance corresponding to that of a half-wave dipole antenna. The antenna combination of the inductance element 7 and the cylindrical sleeve 11 forms a load impedance low enough to match the impedance of the feeder of the coaxial line 10 and requires no impedance matching circuit between the antenna and the radio circuit 3. The insulated cylindrical sleeve 11 does not allow the antenna electric current to leak outside of the outer cover 10*c* and prevents the antenna electric current from flowing in the metal frame 2. This prevents antenna gain deterioration from the operator's hand holding the resin housing 1, for example.

Thus, the chip inductor based coaxial line antenna according to this embodiment is free of impedance matching circuit insertion loss and is a low-cost miniature antenna with half-wave dipole antenna performance and with less antenna gain deterioration effect from the proximity of the operator's body.

Embodiment 4

Figure 7:
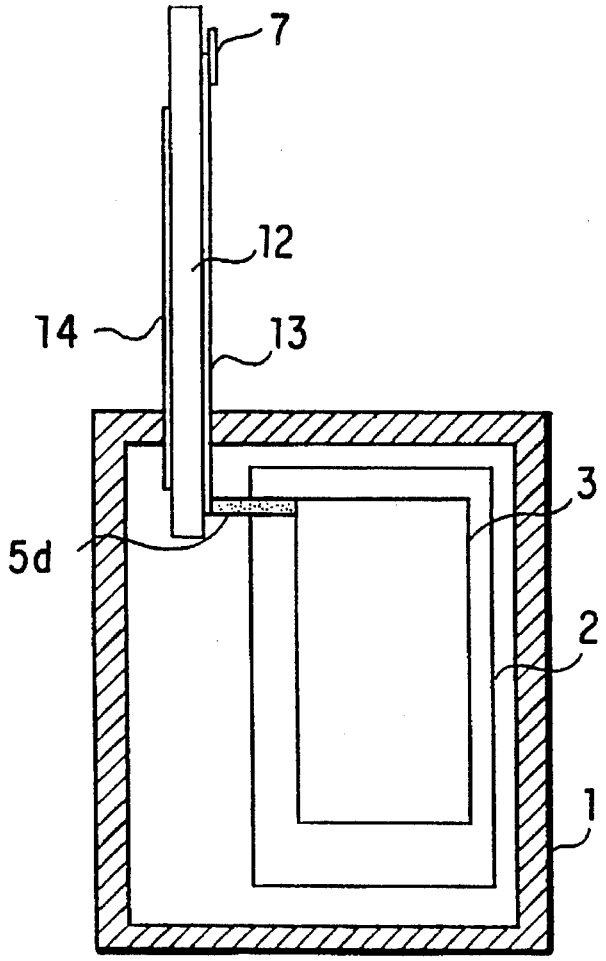
FIG. 7 shows a sectional diagram of a portable radio communication apparatus equipped with a chip inductor flat plane line antenna according to a fourth embodiment of the present invention.
Figure 8:
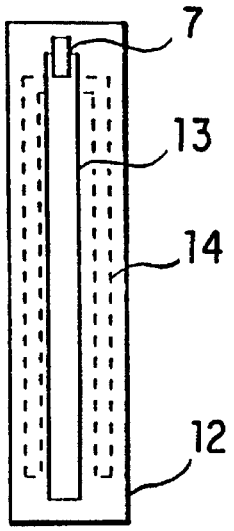
FIG. 8 shows further details of the chip inductor based fiat plane line antenna of FIG. 7.

FIG. 7 shows a sectional diagram of a portable radio communication apparatus equipped with a chip inductor based flat plane line antenna according to a fourth embodiment of the present invention. FIG. 8 is a side view of the antenna of FIG. 7 and illustrates details of the chip inductor based flat plane line antenna of FIG. 7. The embodiment of FIG. 7 modifies the embodiment of FIG. 6 with the substitution of flat plane conductor lines with the inductance element 7 mounted on an antenna board or insulated base for the combination of coaxial line 10 with the inductance element 7 and the cylindrical sleeve 11.

Referring to FIGS. 7 and 8, an antenna board 12 has the flat plate lines of conductors comprising a feeder 13 mounted on one side and a U-shaped conductor sleeve 14 mounted on the opposite side. The flat lines 13 and 14 are mounted at or below the surfaces of the antenna board 12 as shown in FIG. 7. The feeder 13 has the approximately λ/4 wavelength inductance element 7 mounted on and electrically connected to an upper portion and 1s electrically connected to the radio circuit 3 at a lower portion via a connection lead 5*d*. The U-shaped sleeve 14 has an approximately λ/4 wavelength and is fixed on the antenna board 12 with the curve of U-shape at an upper portion and with two open ends at a lower portion connected to a ground of the metal frame 2. The conductor sleeve 14 acts as a shield and prevents the antenna electric current from leaking, so that less antenna gain loss occurs from the deteriorating effect of the operator's hand holding the resin housing 1. As shown in FIG. 8, the U-shaped sleeve 14 extends on both sides of the feeder 13 and is thus wider than feeder 13, which effects the prevention of the antenna electric current from leaking. The antenna board 12 is fixed at a top surface of the insulating resin housing 1 with the lower portion extending within the housing 1.

The combination of the approximately λ/4 wavelength inductance element 7 and the approximately λ/4 wavelength sleeve 14 achieves an antenna performance corresponding to that of a half-wave dipole antenna. The antenna combination of the inductance element 7 and the sleeve 14 has an antenna or load impedance low enough to match the impedance of the feeder and requires no impedance matching circuit between the antenna and the radio circuit 3. This improves antenna performance without impedance matching circuit insertion loss.

The antenna board 12 may be formed of a lower permitivity material for s more stable load impedance and the feeder 13 and the sleeve 14 can be made narrower in width for a more compact and thinner antenna. The chip inductor based antenna may also employ any of the lines of a Lecher line, a strip line or a triplate line for achieving the same antenna performance as that attained with the flat plane line antenna.

Thus, the chip inductor based flat plane line antenna according to this embodiment is free of matching circuit insertion loss and is a low-cost miniature antenna with half-wave dipole antenna performance and lower gain deterioration effect from the proximity of the operator's body.

Embodiment 5

Figure 9:
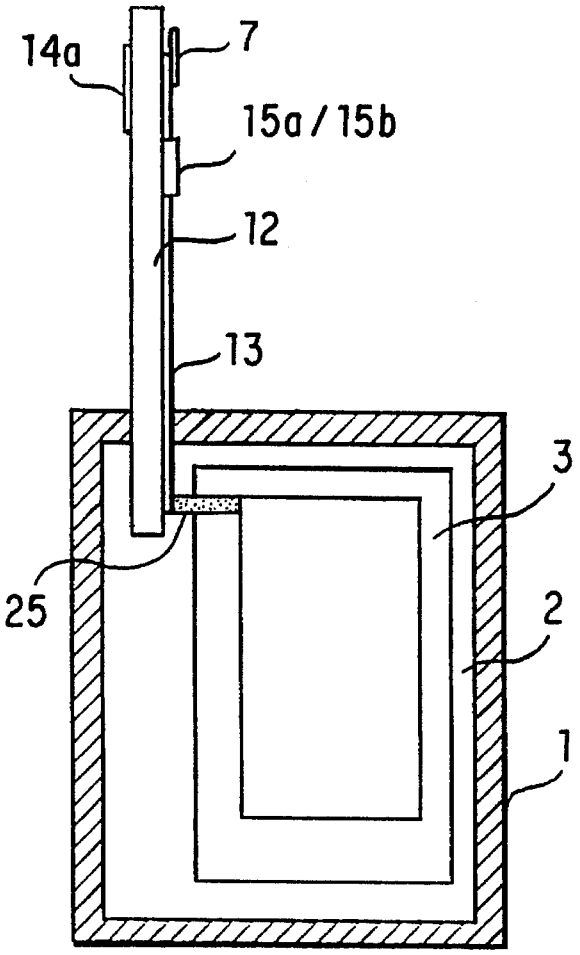
FIG. 9 shows a sectional diagram of a portable radio communication apparatus equipped with another chip inductor flat plane line antenna according to a fifth embodiment of the present invention.
Figure 10:
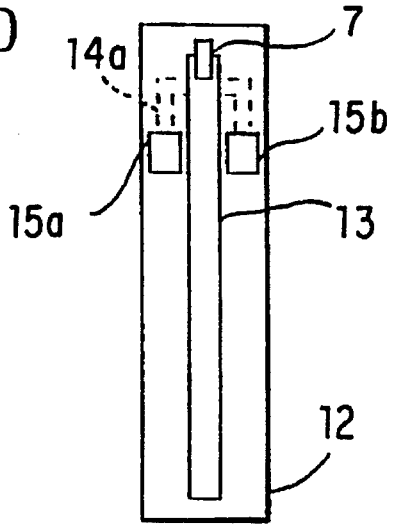
FIG. 10 shows further details of the chip inductor flat plane line antenna of FIG. 9.

FIG. 9 is a sectional diagram of a portable radio communication apparatus equipped with another chip inductor based flat plane line antenna according to a fifth embodiment of the present invention. FIG. 10 is a side view of the antenna of FIG. 9 and illustrates details of the chip inductor based flat plane line antenna of FIG. 9. The embodiment of FIG. 9 modifies the embodiment of FIG. 7 with the substitution of flat plane lines with the inductance element 7 and sleeve inductance elements mounted on the antenna board 12 for the combination of flat plane lines with the inductance element 7 mounted on the antenna board 12. The sleeve inductance elements employ the same chip inductor structure as the inductance element 7 but the wavelength of the sleeve inductance elements is different from that of inductance element 7.

Referring to the figures, the antenna board 12 is fixed on a top surface of the resin housing 1 with the lower portion extending within the housing 1. The antenna board 12 has flat plane line conductor of the feeder 13, and sleeve inductance elements 15*a* and 15*b* mounted on one side. The feeder 13 has the approximately λ/4 wavelength inductance element 7 mounted on and electrically connected to an upper end and is electrically connected to the radio circuit 3 at a lower end via a connection lead 25 of coaxial line. The sleeve inductance elements 15*a* and 15*b*, mounted adjacent and below the inductance element 7 with the feeder 13 in between, are connected to each other on the opposite side of the antenna board 12 via a U-shaped connection line 14*a*. The U-shaped connection line 14*a* is fixed on the opposite side of the antenna board 12 with the curve of U-shape at an upper portion and with the two open ends at a lower portion. The sleeve inductance elements 15*a* and 15*b* are inductance elements which are formed in the same manner as inductance element 7 and are internally connected by the via-hole technique. The U-shaped connection line 14*a* is connected to the ground of the metal frame 2.

The sleeve inductance elements 15*a* and 15*b* have different values of wavelength λ1 and λ2 totaling approximately λ/4 wavelength. This effects an antenna of multi-resonant frequencies for tuning in to different values of frequency. The combination of the approximately λ/4 wavelength inductance element 7 and the approximately λ/4 total wavelength of the sleeve inductance elements 15*a* and 15*b* achieves an antenna performance corresponding to that of a half-wave dipole antenna. The antenna combination of the inductance elements has a low load impedance and requires no impedance matching circuit, so that antenna performance is improved without impedance matching circuit insertion loss. The inductance elements on the antenna board 12 are mounted in a position spaced away from the operator's head during use of the portable radio communication apparatus so that less antenna gain loss occurs from the deteriorating effect of proximity of the operator's body.

The combination of the sleeve inductance elements 15*a* and 15*b* of different wavelength values totalling approximately λ/4 wavelength may be replaced by inductance elements which have values of wavelength equal to each other for the corresponding antenna performance. Another replacement for the sleeve inductance elements 15*a* and 15*b* may be only one sleeve inductance element having approximately λ/4 wavelength.

Thus, the art of the chip inductor based flat plane line antenna according to this embodiment is free of impedance matching circuit insertion loss and is a multi-resonant miniature antenna with half-wave dipole antenna performance and lower gain deterioration effect from the proximity of the operator's body.

Embodiment 6

Figure 11:
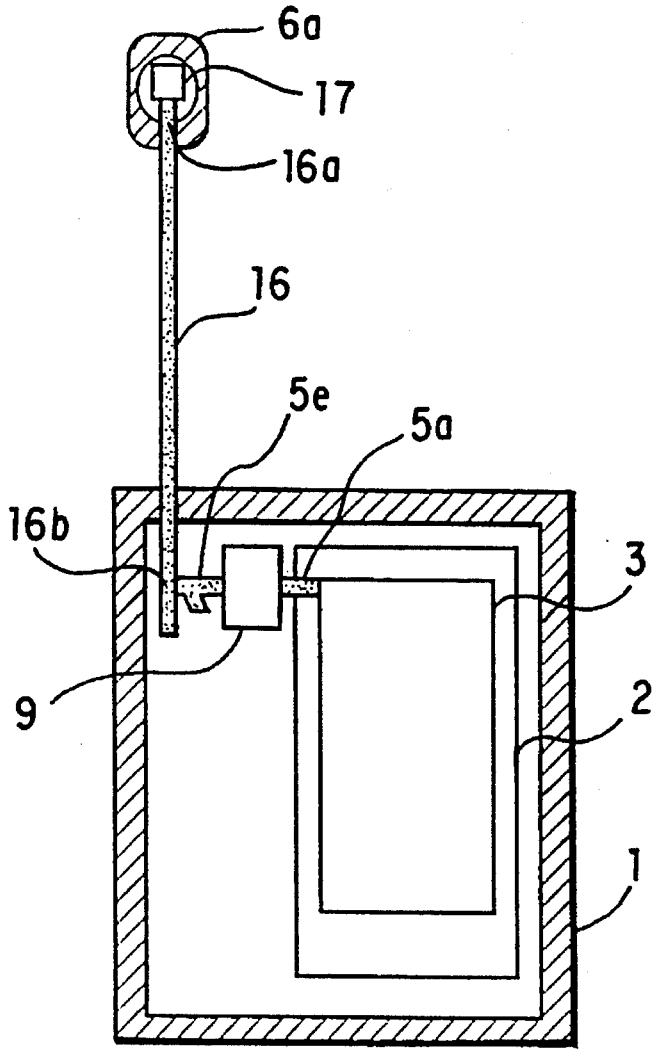
FIG. 11 shows a sectional diagram of a portable radio communication apparatus equipped with a chip inductor whip antenna according to a sixth embodiment of the present invention.

FIG. 11 is a sectional diagram of a portable radio communication apparatus equipped with a chip inductor based whip antenna according to a sixth embodiment of the present invention. The embodiment of FIG. 11 modifies the embodiment of FIG. 4 with the substitution of a whip antenna with an inductance element for the approximately λ/2 wavelength inductance element 8 of FIG. 4.

Referring to FIG. 11, a whip antenna 16 is fixed on a top surface of the resin housing 1 in a movable manner between a stored position within the resin housing 1 and an extended position outside of the housing 1. An inductance element 17, which is of the same multi-layered chip inductor material and structure as that shown in FIGS. 2A and 2B and described above in connection therewith, is mounted on the top end 16*a* of the whip antenna 16 with an insulating cover 6*a*. The whip antenna 16 is connected electrically to the impedance matching circuit 9 at a lower end 16*b* via a connection lead 5*e* in the extended position and near the upper end 16*a* in the stored position. The matching circuit 9 is connected to the radio circuit 3 via connection lead 5*a*.

The combination of the whip antenna 16 and the inductance element 17 has a total wavelength of approximately λ/2 and achieves an antenna performance corresponding to that of a half-wave dipole antenna. The whip antenna 16 is adjustable in wavelength with its physical length extended or shortened in a flexible manner. When the resin housing 1 has its physical height less than λ/2, for example, the whip antenna 16 is extended until it reaches approximately λ/2 wavelength in total together with the inductance element 17. The whip antenna has a structural advantage of avoiding the antenna gain deterioration from the proximity of the operator's body by providing the inductance element 17 mounted on the top of the antenna 16 spaced away from the operator's head.

Thus, the chip inductor based whip antenna according to this embodiment is a flexible low-cost miniature antenna with half-wave dipole antenna performance and less gain deterioration effect from the proximity of the operator's body.

Embodiment 7

Figure 12:
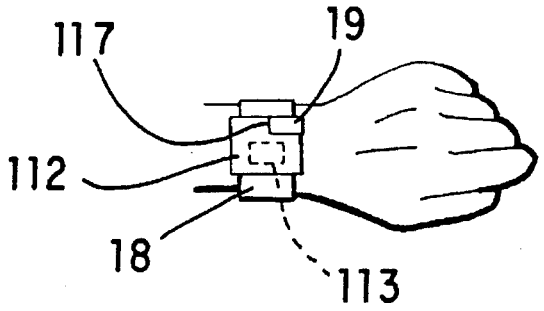
FIG. 12 shows a sectional diagram of a wristwatch-type radio communication apparatus equipped with a chip inductor miniature antenna according to a seventh embodiment of the present invention.

FIG. 12 is a diagram of a wristwatch-type radio communication apparatus equipped with a chip inductor based miniature antenna according to a seventh embodiment of the present invention.

Referring to the figure, the wristwatch-type radio communication apparatus is worn on the wrist and secured with a wristband 18. The wristwatch-type radio communication apparatus includes an inductance element 117 covered on the top surface by an insulating plastic plate or resin cover 19, which is mounted outside on a metal case or metal housing 112 of the apparatus. The metal housing 112 encloses a radio circuit 113 which is shown in dotted lines and which is positioned within the apparatus. The inductance element 117 is of the same multilayered chip inductor material and structure as that shown in FIGS. 2A and 2B and described above in connection therewith. The inductance element 117 acts as an approximately λ/4 wavelength monopole antenna when fed by the radio circuit 113 via a connection lead which is not shown in the figure. The metal housing 112 has an approximately λ/4 wavelength and serves as a ground plane of the monopole antenna of the inductance element 117. The metal housing 112 gives the radio circuit 113 an electro-magnetic shield when insulated by the insulating wristband 18 from the operator's wrist. The approximately λ/4 wavelength monopole antenna has a load impedance low enough to require no impedance matching circuit between the antenna and the radio circuit 113, which allows the inductance element 117 to be connected directly to the radio circuit 113. The combination of the approximately λ/4 wavelength inductance element 117 and the approximately λ/4 wavelength metal housing 112 achieves an antenna performance corresponding to that of a half-wave dipole antenna.

The insulating resin cover 19 may cover not only the top surface of the inductance element 117 but also the top surface as well as the whole surface of the metal housing 112 so that the metal housing 112 is completely insulated from the wrist.

Figure 13:
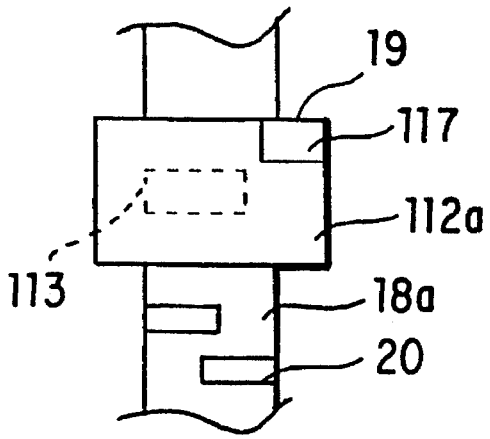
FIG. 13 shows another wristwatch-type radio communication apparatus equipped with the chip inductor antenna of FIG. 12.
Figure 14:
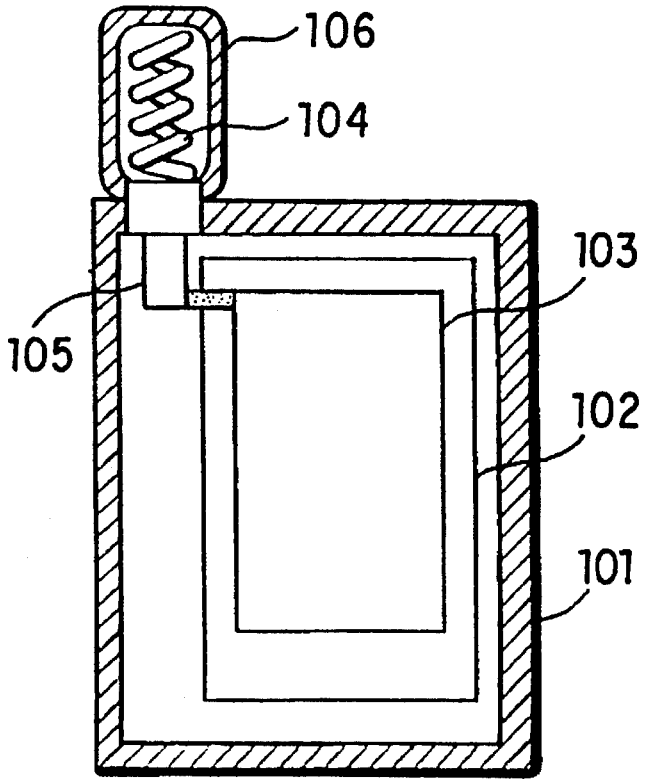
Fig.14 CONVENTIONAL ART
FIG. 14 shows a sectional portable radio communication apparatus equipped with a conventional helical antenna.

FIG. 13 shows a wristwatch-type radio communication apparatus equipped with the chip inductor based antenna of the embodiment of FIG. 12 and utilizing a metal housing 112*a* having an wavelength less than λ/4. The λ/4 wavelength may be obtained with the combination of the metal housing 112*a* and a wristband 18*a* which is given a metal coating on its top surface and connected to the metal housing 112*a*. Some slits 20 may be even added to the metal coated wristband 18*a* to increase the equivalent wavelength when the combination of the housing 112*a* and the wristband 18*a* is not enough for the desired wavelength.

Thus, the chip inductor based antenna according to this embodiment is free of impedance matching circuit insertion loss and is a low-cost miniature antenna suited to miniaturized, wristwatch-type application for example, or a portable radio communication apparatus, with half-wave dipole antenna performance and lower gain deterioration effect from the proximity of the operator's body.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only, and is not intended to be limiting. The invention is limited only as defined in the following claims and the equivalents thereof.

What is claimed is:

1. An antenna equipment for use with radio waves of a predetermined wavelength comprising:

a metal case for containing a radio circuit;

a plastic case surrounding and electrically insulating the metal case; and an antenna element of a predetermined wavelength for transmitting/receiving radio waves from/to the radio circuit, the antenna element comprising a multilayered inductance element formed of a plurality of sheets of insulating material stacked upon one another to form a stack, with conductor segments of a spirally shaped inductance element being carried separately on the sheets and being electrically connected to each other through via-holes extending through the sheets to form the multilayered inductance element in the form of a continuous conductor formed of the conductor segments and extending spirally within the stack of the sheets;

the antenna element being mounted externally of the metal case.

2. The antenna equipment of claim 1 wherein the multilayered inductance element has an equivalent length equal to approximately a quarter of a wavelength, and wherein the multilayered inductance element forms an element of a dipole antenna with the metal case acting as a ground.

3. The antenna equipment of claim 2 wherein the metal case has an equivalent length equal to approximately a quarter of a wavelength, and wherein the metal case forms an element of a dipole antenna.

4. The antenna equipment of claim 1, further comprising an impedance matching circuit for matching impedance between the multilayered inductance element and the radio circuit, wherein the multilayered inductance element forms a half wavelength monopole antenna element.

5. The antenna equipment of claim 1, further comprising a coaxial line having a metal casing and being connected between the radio circuit and the multilayered inductance element, for transmitting/receiving radio waves from/to the radio circuit, wherein an end of the metal casing of the coaxial line is connected to the metal case.

6. The antenna equipment of claim 5, further comprising a coaxial sleeve for shielding the coaxial line from radiation, wherein an end of the coaxial sleeve is connected to an end of the metal casing of the coaxial line.

7. The antenna equipment of claim 6, wherein the coaxial sleeve has length of a quarter of the wavelength.

8. The antenna equipment of claim 1, further comprising a feeder connected between the radio circuit and the inductance element on an insulated base for transmitting/receiving the radio wave from/to the radio circuit and a conductor sleeve on the other side of the insulated base, for shielding.

9. The antenna equipment of claim 8, wherein the width of the feeder connected between the radio circuit and the inductance element is narrower than the width of the conductor sleeve acting as a ground.

10. The antenna equipment of claim 8, further comprising a second multilayered inductance element having an equivalent length of approximately a quarter of a wavelength, the second multilayered inductance element being formed of a plurality of sheets of insulating material stacked upon one another to form a stack, with conductor segments of a spirally shaped inductance element being carried separately on the sheets and being electrically connected to each other through via-holes extending through the sheets to form the multilayered inductance element in the form of a continuous conductor formed of the conductor segments and extending spirally within the stack of the sheets, and wherein the multilayered inductance element and the second multilayered inductance element together form a dipole antenna.

11. The antenna equipment of claim 10, wherein the second multilayered inductance is comprised of plurality of multilayered inductance element structures of the same structures as recited in claim 11.

12. The antenna equipment of claim 11, wherein each of the plurality of multilayered inductance element structures of the second multilayered inductance element is tuned to a selected wavelength.

13. The antenna equipment of claim 1, further comprising flat plate lines for transmitting/receiving the radio wave from/to the radio circuit, wherein one line of the flat plate lines is connected between the radio circuit and the inductance element, and wherein the other lines of the flat plate lines are connected to the metal case.

14. The antenna equipment of claim 1, further comprising a whip antenna connected between the radio circuit and the multilayered inductance element for transmitting/receiving the radio wave from/to the radio circuit, the whip antenna having a length equal to a quarter of a wavelength, wherein one end of the whip antenna is connected to the radio circuit through an impedance-matching circuit.

15. The antenna equipment of claim 1 in combination with a cellular telephone, wherein the antenna equipment acts as an antenna in the cellular telephone.

16. The antenna equipment of claim 1 in combination with a mobile communication apparatus, wherein the antenna equipment acts as an antenna in the mobile communication apparatus.

17. An antenna equipment for use with radio waves of a predetermined wavelength comprising:

a metal case for containing a radio circuit;

a multilayered inductance element forming a first element of an antenna with an equivalent wavelength approximately corresponding to the predetermined wavelength for transmitting/receiving the radio waves from/to the radio circuit, wherein the multilayered inductance element is formed of a plurality of sheets of insulating material stacked upon one another to form a stack, with conductor segments of a spirally shaped inductance element being carried separately on the sheets and being electrically connected to each other through via-holes extending through the sheets to form the multilayered inductance element in the form of a continuous conductor formed of the conductor segments and extending spirally within the stack of the sheets to form a spiral antenna element;

a metal band for supporting the metal case and the multilayered inductance element, wherein the combination of the metal band and the metal case, acting as a ground, forms a second element of the antenna which has as a first element thereof the multilayered inductance element; and a plastic plate for insulating the multilayered inductance element and the metal case.

18. The antenna equipment of claim 17, wherein the metal band has slits formed therein for extending the equivalent electrical length thereof relative to the multilayered inductance element.

* * * * *